United States Patent [19]

Breuer et al.

[11] Patent Number: 4,784,280

[45] Date of Patent: Nov. 15, 1988

[54] SEALING CAP WITH A SAFETY BAND

[75] Inventors: Hans-Werner Breuer, Himmelried; Franz T. Bartl, Allschwil, both of Switzerland

[73] Assignee: Crown Cork AG, Reinach, Switzerland

[21] Appl. No.: 152,766

[22] Filed: Feb. 5, 1988

[30] Foreign Application Priority Data

Feb. 26, 1987 [CH] Switzerland ..... 737/87

[51] Int. Cl.[4] ..... B65D 41/34

[52] U.S. Cl. ..... 215/252; 215/253

[58] Field of Search ..... 215/252, 253

[56] References Cited

U.S. PATENT DOCUMENTS

| | | | |
|---|---|---|---|
| 4,394,918 | 7/1983 | Grussen | 215/252 |
| 4,635,808 | 1/1987 | Nolan | 215/252 |
| 4,664,279 | 5/1987 | Obrist et al. | 215/252 |

*Primary Examiner*—Donald F. Norton

*Attorney, Agent, or Firm*—William R. Hinds

[57] ABSTRACT

The sealing cap (1) has a tear-off safety band (3) on its lower edge, the safety band having inwardly-projecting tongues (6) on its inner wall (5). A clip (7) is provided below each tongue. When a container opening is sealed for the first time, the tongues (6) are bent upwards and engage below a bulge on the container opening. The tongues are prevented from bending downwards by the clips (7), so that when the sealing is first removed, the safety band (3) is torn off.

7 Claims, 2 Drawing Sheets

SEALING CAP WITH A SAFETY BAND

Figure 1:
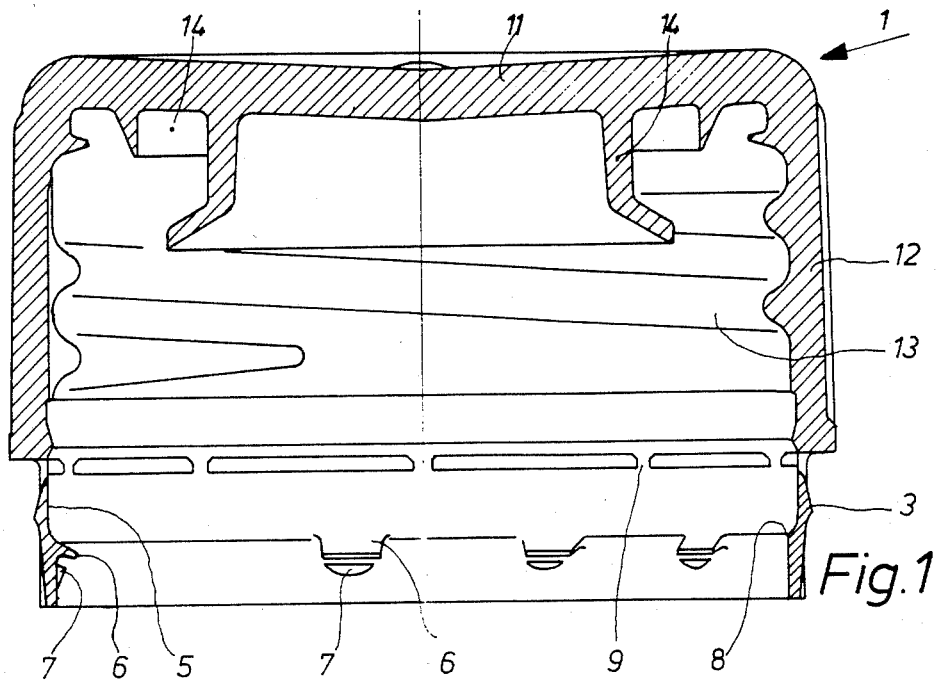

The invention relates to a sealing cap for sealing the opening of a container according to the generic part of claim 1. Sealing caps of this kind have a safety function in that the first opening of the sealing cap is indicated by the tearing-off of the safety band. Unlike heat-shrinkable safety bands, the bands of the kind named are mechanical safety bands which engage independently below the bulge on the bottle opening.

One problem in the case of safety bands provided with spring-back tongues is that, on opening, the axial force component can be so great that the tongues spring back even during unscrewing and slide over the bulge again so that the safety band does not tear off. Sealing caps are generally made of thermoplastic material by the injection-moulding process, in which case the properties of the material can vary greatly according to the ambient temperature. Thus the tongues may have a substantially greater flexibility in summer temperatures, so that their locking function is impaired. On the other hand, it is not possible to form the tongues too solidly, as this would necessitate too great a stretching of the safety band when the container opening is sealed for the first time.

A sealing cap of a comparable kind is known from the U.S. Pat. No. 4,550,844 in which the tongues are more thickly-formed at the end than at the joining point. The object of this is that the thickened end should be better held under the bulge to prevent any bending-back when the sealing cap is removed. On the other hand, the pivotability of the tongues is increased by the decreased thickness of the joining points, thus again giving rise to the danger that the tongues might completely bend back into the original initial position. Moreover, as far as tools are concerned, the thickened end of the tongues are difficult to remove from the mould.

It is therefore an object of the invention to produce a sealing cap of the kind cited at the beginning in which the tongues slide over the bulge with the least possible resistance when the container opening is sealed for the first time, whereby the tongues, when engaged, cannot be bent in the opposite direction. This object is achieved according to the invention by a sealing cap having the features of claim 1. The clips under the tongues do not in practice binder the putting-on process as the safety band is, to a limited extent, stretchable when first being put on. The tongues can be bent back easily towards the top until they spring back under the bulge, thus engaging under the latter. On the contrary, the pins support the tongues on their lower side so that the tongues can only be bent towards the bottom to a limited extent. The forces acting in the axial direction thus increase so that the safety band tears off before being able to slide over the bulge on the container opening as a result of overstretching.

The locking effect of the tongues can further be increased by placing a locking ridge on the inside of the safety band, approximately in the plane of the tongues. By means of this locking ridge, which is formed as a tapering of the inner diameter, the tearing-off forces can be suited exactly to the respective conditions.

The safety band slides particularly easily over the bulge on the container opening when the sealing cap is put on for the first time if the clips taper towards the lower edge of the safety band.

If the clips are disposed at a distance from the tongues, the flexibility of the tongues, which is desirable per se, is in no way impaired when the sealing cap is put on for the first time. The tongues are advantageously formed such that they project inwardly in the radial direction beyond the clips. Thus the locking function of the tongues is increased as, in an extreme case, the tongues are placed around the outer edges of the clips, thus causing a substantial reduction of the diameter.

If the safety band is connected to the cap via predetermined breaking-point webs, the tongues are advantageously disposed between the webs. Thus the predetermined breaking-point webs are not excessively stressed when the sealing cap is put on for the first time, as the safety band can stretch more easily radially. Instead of predetermined breaking-point webs, the safety band could also be connected to the lower edge of the cap via a thin film of material.

In the case of a screw-on cap, in particular for multi-way bottles, a vertical predetermined breaking point is also advantageously disposed on the safety band, so that the latter does not remain under the bulge of the bottle opening after tearing-off. The tearing-off process can in this case be, in particular, optimally controlled if a tongue is disposed closer to the vertical predetermined breaking point in the unscrewing direction than in the screwing-on direction.

An embodiment of the invention is illustrated in the drawings and is subsequently described in more detail.

FIG. 1 shows a transverse section through a screw-on cap according to the invention, FIG. 2 a view from below of the screw-on cap according to FIG. 1, FIG. 3 the safety band in a first stage of the putting-on process, FIG. 4 the safety band in a second stage of the putting-on process, FIG. 5 the safety band in the case of a sealing cap which has been put on, and FIG. 6 the safety band in the case of the first removal of the sealing cap.

As illustrated in FIG. 1, a sealing cap 1 consists of a cap base 11 and a cylindrical cap side wall 12, which is provided with an internal thread 13. Various 14 seals for the opening can be disposed on the cap base or in the transitional region between the cap base and the cap side wall. A safety band 3 is disposed on the lower edge of the sealing cap and is connected to the cap via predetermined breaking point webs 9. The sealing cap does not necessarily have to be a screw-on cap. A so-called snap seal could also be provided with a safety band according to the invention.

As illustrated in FIG. 1, inwardly-projecting tongues 6 are disposed at set intervals on the inner wall 5 of the safety band. The tongues taper slightly in transverse section towards their outer end and are slightly inclined downwards, which facilitates their removal from an axially-opening tool. A clip 7, which tapers downwards, is disposed at a set distance below each tongue 6. Each clip extends approximately beyond the total length of a tongue, but seen in plan view is approximately crescent-shaped.

A locking ridge 8, which is formed as a diameter-tapering of the inner wall 5, extends over the total circumference approximately at the level of the tongues 6. The locking ridge improves the retaining effect of the tongues 6.

Figure 2:
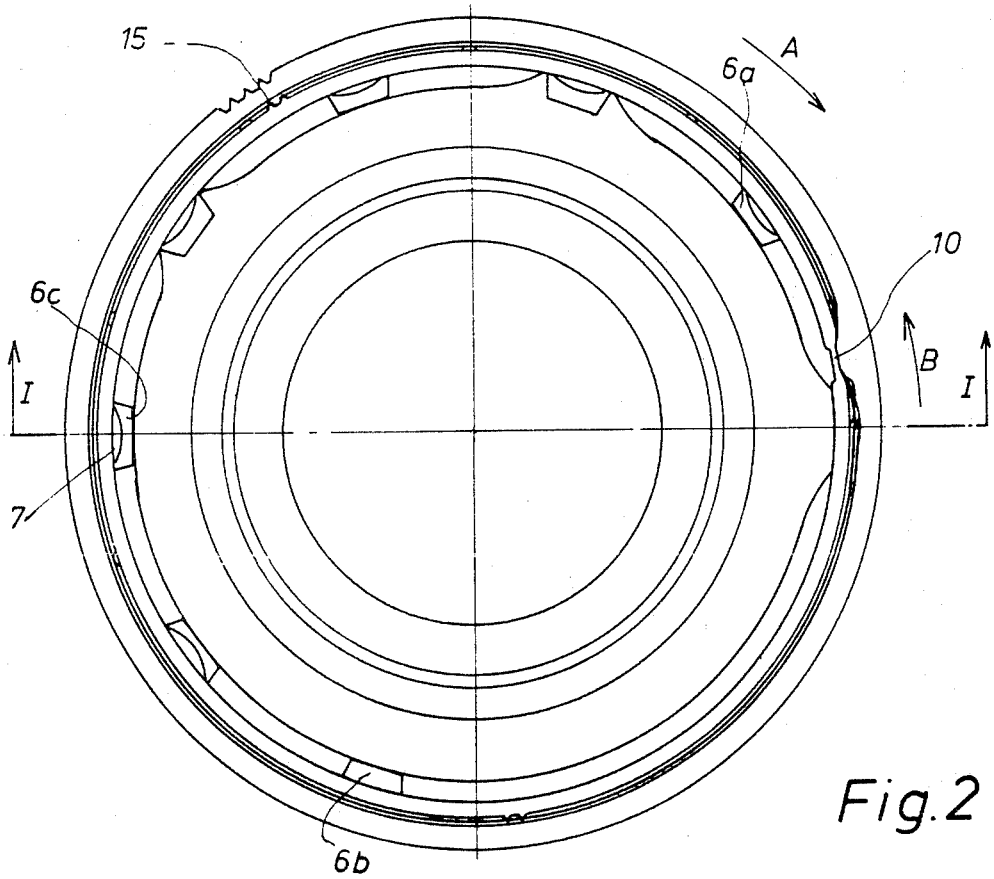
Figure 3:
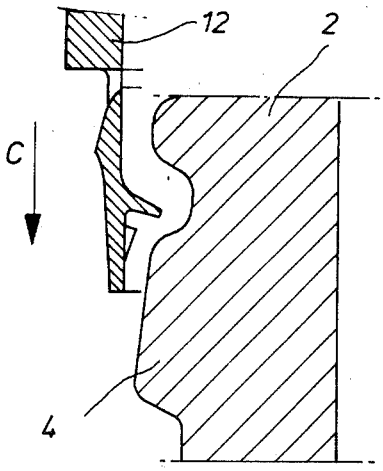

As shown in FIG. 2, the tongues do not have to be distributed at regular intervals around the circumference. In particular, if a vertical predetermined breaking point 10 is additionally provided on the safety band, it may be advantageous to dispose the tongues at different distances. Thus in FIG. 2, for example, a tongue 6a is provided which lies closer to the vertical predetermined breaking point 10 in the unscrewing direction A than the tongue 6b in the screwing-on direction B. Furthermore, no clip 7 is provided on the tongue 6b, so that this tongue can bend back more than the other tongues. The tongues with clips are distributed in the embodiment according to FIG. 2 approximately over a sector of 180°, the tongue 6c being disposed approximately diametrically opposite the vertical predetermined breaking point 10. In order to make the safety band easier to grip, axially-extending knurling 15 can be provided, as is generally provided on the cap side wall 12.

The function of the tongues is described in more detail below with the aid of FIGS. 3 to 6. FIG. 3 shows the position of a tongue 6 when the sealing cap is first screwed on, the safety band 3 being pushed down against the bulge 4 on the container opening 2 in the direction of the arrow C. Container openings of this kind are standardised, in particular in the case of bottles for refreshment drinks, so that the same masses and tolerances are always involved. The inner diameter of the safety band and the length of the tongues are dimensioned such that the safety band can be pushed over the bulge 4 with minimal stretching of its circumference, but without damaging the predetermined breaking point 9.

Figure 4:
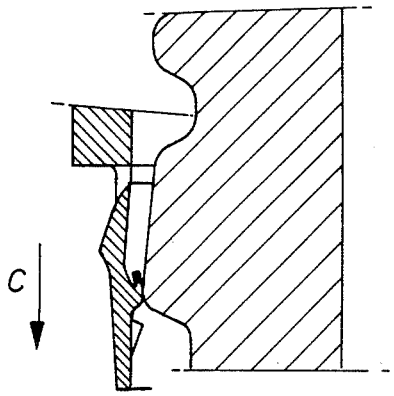
Figure 5:
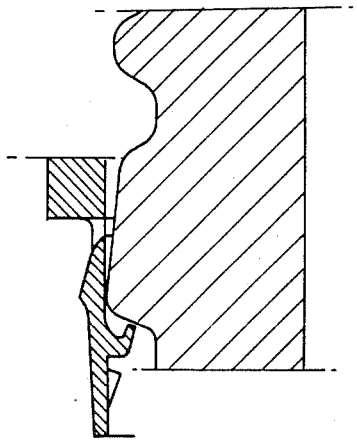

As soon as the tongues touch the bulge 4, they are bent upwards, as shown in FIG. 4. Since the clips 7 taper downwards and are moreover approximately crescent-shaped, these also slide easily over the bulge 4.

Figure 6:
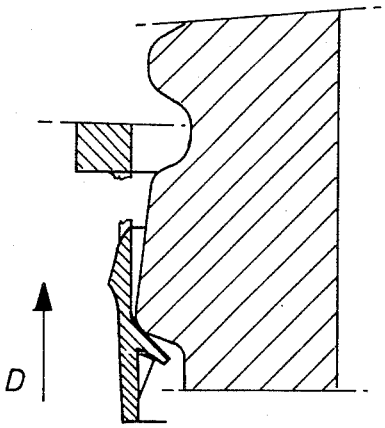

FIG. 6 shows the position of the tongues when a force component is acting on the safety band in the direction of the arrow D when the sealing cap is first removed. In this case, the tongues tend to bend back downwards again, but are restrained by the clips 7. The safety band could only conceivably pass over the bulge 4 after being stretched excessively, since the tongues are restrained toward the bottom. However, as tensile force is increased, the predetermined breaking point webs 9 tear, as illustrated in FIG. 6. The safety band is preferably connected to the lower edge of the cap via a single, reinforced joining web, so that it can be completely removed from the container opening after the vertical predetermined breaking point has torn.

We claim:

1. A sealing cap (1) for sealing a container opening (2), having a tear-off safety band (3) disposed on the lower edge of the cap, the said safety band being intended to engage under an annular bulge (4) on the container opening when the cap is put on, the said safety band having, to this end, a plurality of flexible tongues (6), which are oriented towards the central axis and which may be bent back when the cap is first put on and engage under the bulge (4) in the final position of the cap, characterised in that clips (7) are disposed below the tongues, at least partly on the side facing away from the cap base (11), the tongues (6) bearing against the clips when axial force is acting on the safety band in the opening direction.

2. A sealing cap according to claim 1, characterised in that a locking ridge (8) is disposed on the inside of the safety band (3), approximately in the plane of the tongues (6).

3. A sealing cap according to claim 1, characterised in that the clips (7) taper towards the lower edge of the safety band.

4. A sealing cap according to claim 3, characterised in that the clip (7) are disposed at a distance from the tongues (6).

5. A sealing cap according to claim 1, characterised in that the tongues (6) project inwards beyond the clips (8) in the radial direction.

6. A sealing cap according to claim 1, characterised in that the safety band (3) is connected to the cap via predetermined breaking point webs (9), and in that the tongues (6) are disposed between the predetermined breaking point webs (9).

7. A sealing cap according to claim 1, characterised in that it is a screw-on cap and in that the safety band is provided with a vertical predetermined breaking point (10), whereby a tongue is closer to the vertical predetermined breaking point (10) in the unscrewing direction (A) than in the screwing-on direction (B).

* * * * *